US006062923A

United States Patent [19]

Kai

[11] Patent Number: 6,062,923

[45] Date of Patent: May 16, 2000

[54] TILT-TRIM DEVICE FOR MARINE PROPULSION UNIT

[75] Inventor: Shigeru Kai, Saitama, Japan

[73] Assignee: Showa Corporation, Saitama, Japan

[21] Appl. No.: 09/133,305

[22] Filed: Aug. 13, 1998

[30] Foreign Application Priority Data

Sep. 30, 1997 [JP] Japan ..... 9-281097

[51] Int. Cl.[7] ..... B63H 5/125

[52] U.S. Cl. ..... 440/61

[58] Field of Search ..... 92/165 R, 169.1, 92/169.4, 171.1; 440/61, 900, 53

[56] References Cited

U.S. PATENT DOCUMENTS

| | | | |
|---|---|---|---|
| 3,811,367 | 5/1974 | Bimba | 92/165 |
| 4,050,359 | 9/1977 | Mayer | 92/113 |
| 5,014,601 | 5/1991 | Sundholm | 92/109 |

FOREIGN PATENT DOCUMENTS 5-3761 1/1993 Japan .

*Primary Examiner*—Ed Swinehart
*Attorney, Agent, or Firm*—Dvorak & Orum

[57] ABSTRACT

A tilt-trim device (17) for a marine propulsion unit comprises a cylinder means 18 with a rod guide (29) is fixed to the end portion of an outer cylinder (22) a piston (23)fixed to one end portion of a piston rod (24)is freely slidably disposed within an inner cylinder (21) and a hydraulic fluid is filled within the cylinder; and the piston rod passes through the rod guide; a tank device (20) in which the hydraulic fluid can be stored; and a pump device (19) intended to supply into and discharge from the cylinder device the hydraulic fluid within the tank device, thereby causing the expansion and contraction operation of this cylinder device. In this tilt-trim device, each of the inner and outer cylinders is made of pipe material, and the end portion of the outer cylinder is bent inwardly, whereby the rod guide is fixed to the outer cylinder by bent portion(30).

2 Claims, 8 Drawing Sheets

TILT-TRIM DEVICE FOR MARINE PROPULSION UNIT

BACKGROUND OF THE INVENTION

1. Field of the Invention

The present invention relates to a tilt-trim device for a marine propulsion unit.

2. Description of the Related Art

Examples of tilt-trim devices for marine propulsion units include a tilt-trim device of an outboard motor. The outboard motor includes a propulsion unit comprising a propeller and an engine, supported axially by a swivel bracket such that the horizontal swinging movement is allowed, with the swivel bracket supported by a clamp bracket such that the vertical tilting movement is allowed, with the clamp bracket gripping a hull. A tilt-trim device is provided between the clamp bracket and the swivel bracket such that the motive power is generated by the telescopic motion of a hydraulic cylinder of the tilt-trim device. The propulsion unit and the swivel bracket are tilted vertically with respect to the clamp bracket so as to allow the tilt operation or the trim operation of the propulsion unit.

The above-described hydraulic cylinder device has a rod guide fixed to an end of the cylinder. And a piston fixed to one end portion of a piston rod is freely slidably disposed within the cylinder and in addition a hydraulic fluid is filled therein. In addition, the piston rod passes through a rod guide.

Generally, the cylinder of the hydraulic cylinder device is cast-molded using an aluminum alloy. Also, generally, the fixing of the rod guide to the end portion of the cylinder is performed by bringing an internal thread formed in the inner periphery of the end portion of the cylinder and an external thread formed on the outer periphery of the rod guide into engagement with each other as shown in, for example, Japanese Utility Model Application Publication (JP-Y) No. 5-3761.

Since, as described above, the rod guide is fixed to the inner periphery of the end portion of the cylinder by the thread connection, the mounting operation for the rod guide becomes inconveniently complex.

SUMMARY OF THE INVENTION

An object of the present invention is to provide a tilt-trim device for a marine propulsion unit enabling easy fixing of the rod guide to the cylinder. Another object of the present invention is to provide a tilt-trim device for a marine propulsion unit which can prevent the pooling of water in the end surface on the rod guide side of the cylinder device and render this end surface unlikely to rust.

The present invention provides a tilt-trim device for a marine propulsion unit comprising a cylinder device wherein a rod guide is fixed to the end portion of a cylinder; a piston fixed to one end portion of a piston rod is disposed freely slidably within the cylinder and a hydraulic fluid is filled within the cylinder; and the piston rod passed through the rod guide, a tank device enabling the storage of the hydraulic fluid therein, and a pump device intended to supply into and discharge from the cylinder device the hydraulic fluid within the tank device to thereby expand and contract this cylinder device, thereby causing the tilt-trim operation of the propulsion unit by the expansion and contraction operation of the cylinder device, in which the cylinder is made of pipe material and, by bending inwardly the end portion of this cylinder, the rod guide is fixed to the cylinder.

BRIEF DESCRITIION OF THE DRAWINGS

The present invention will be understood more fully from the detailed description given hereinbelow and from the accompanying drawings of the preferred embodiments of the invention.

Figure 2:
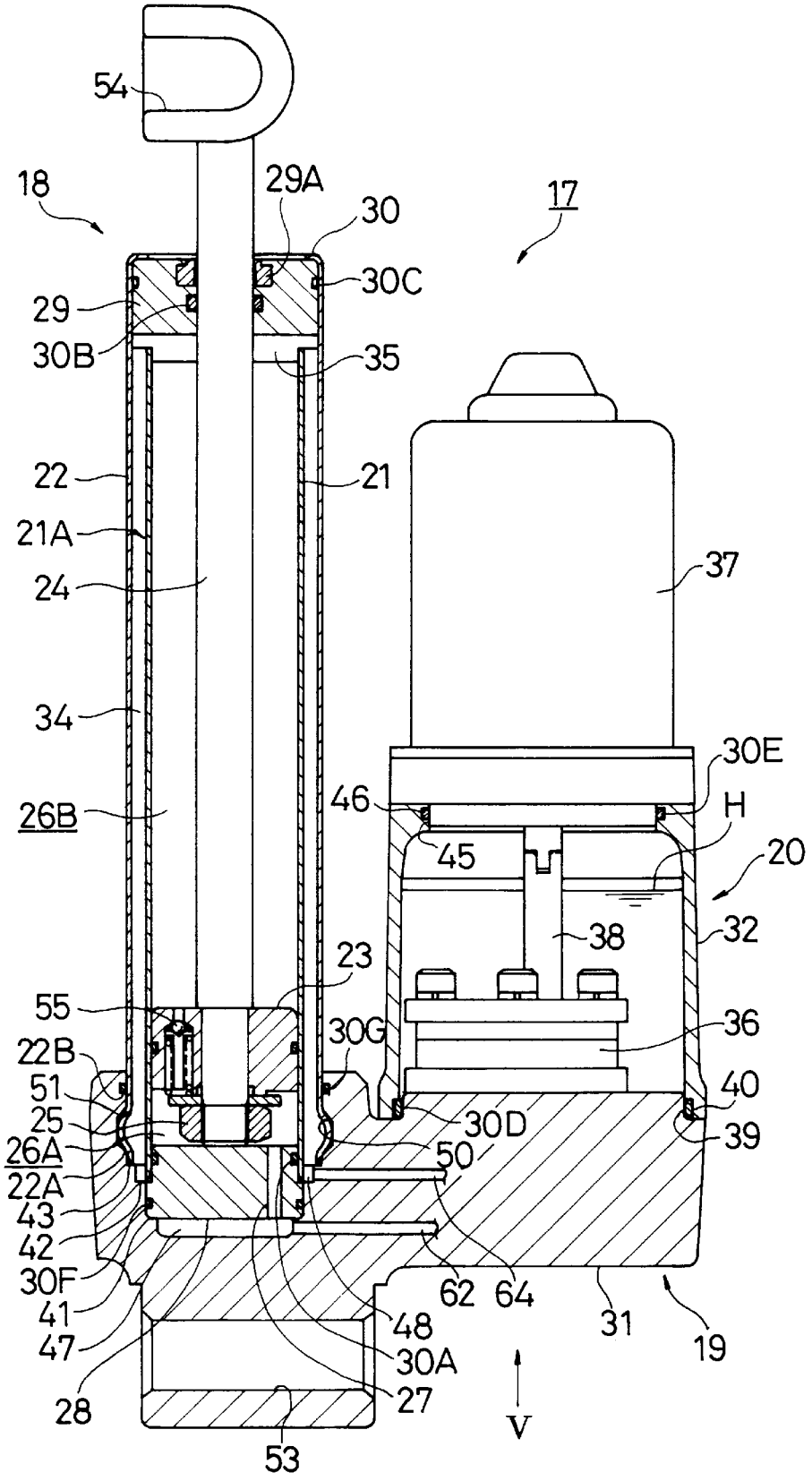
FIG. 2 is a cross-sectional view of the tilt-trim device.
Figure 7:
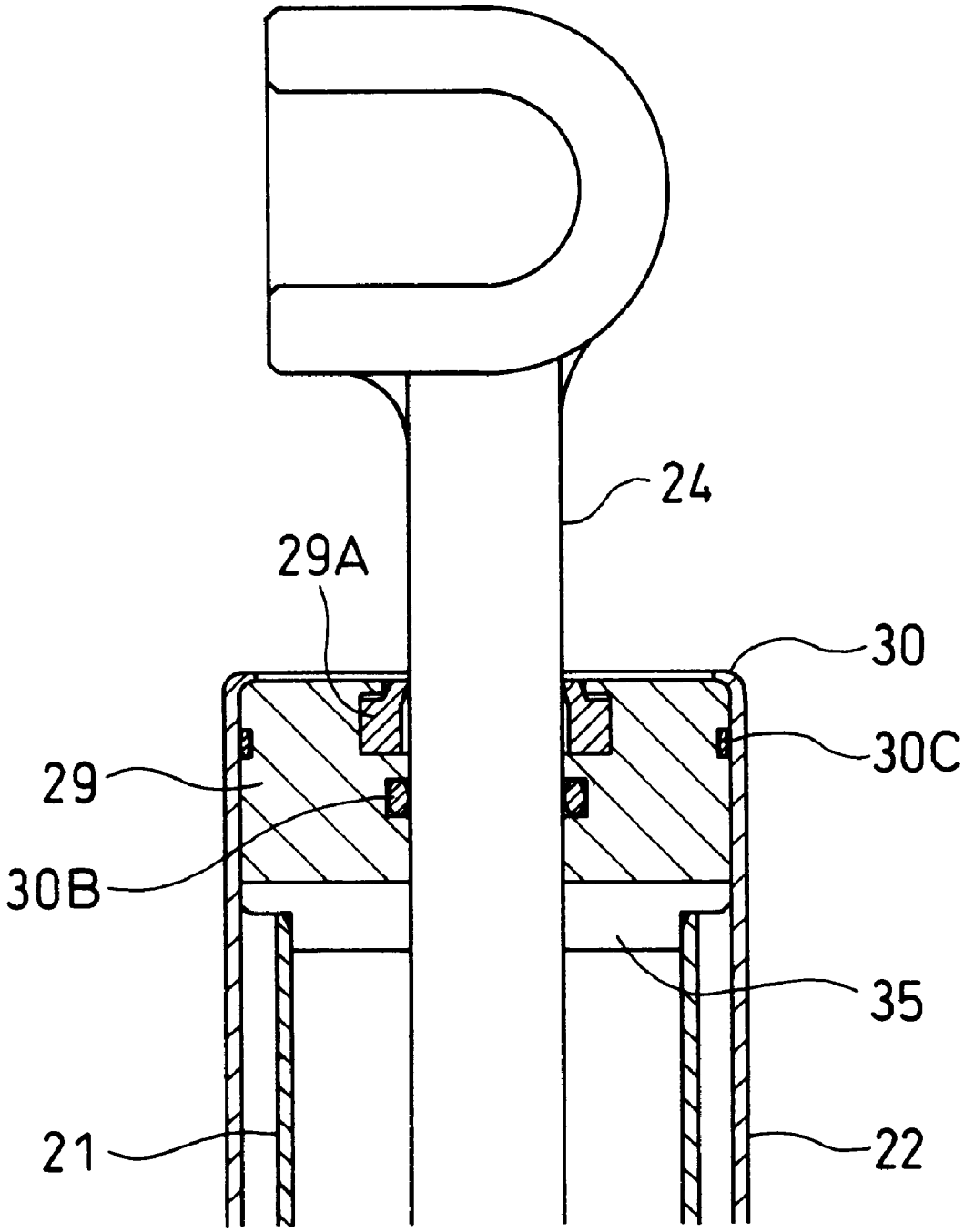
Figure 8:
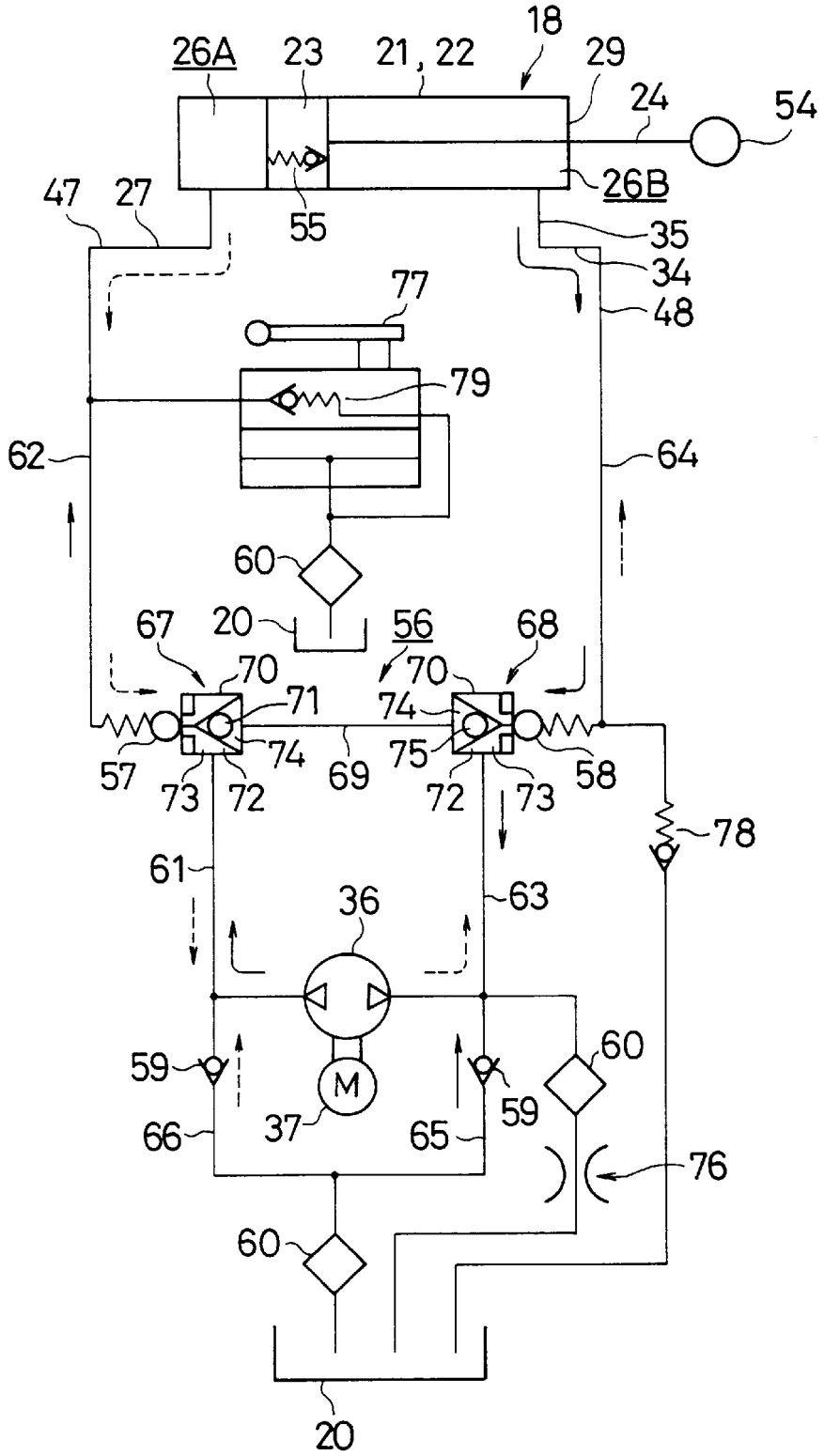
Figure 9:
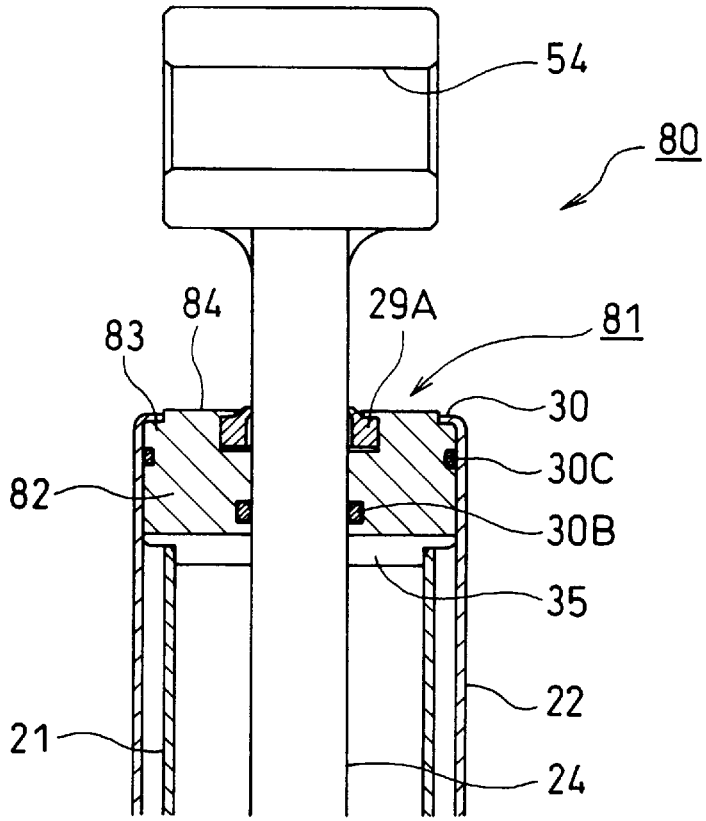
Figure 10:
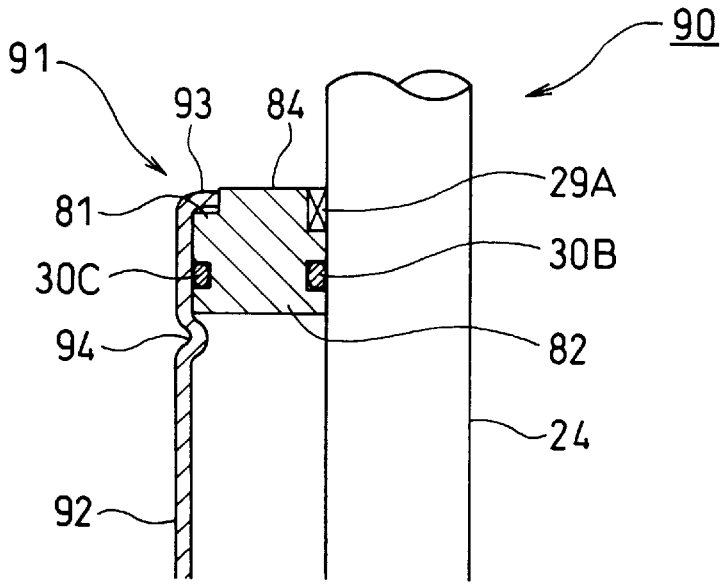

FIG. 7 ia an enlarged cross-sectional view of the other end portion of the cylinder;

FIG. 8 is a circuit diagram of a hydraulic circuit of the tilt-trim device of FIG. 2;

FIG. 9 is a cross-sectional view of an outboard motor applied with a second embodiment of a tilt-trim device for a marine propulsion unit of the present invention; and FIG. 10 is a cross-sectional view of an outboard motor applied with a third embodiment of a tilt-trim device for a marine propulsion unit of the present invention.

DESCRIPTION OF THE PREFERRED EMBODIMENTS

Hereinafter embodiments of the present invention will be described with reference to the accompanied drawings.

Figure 1:
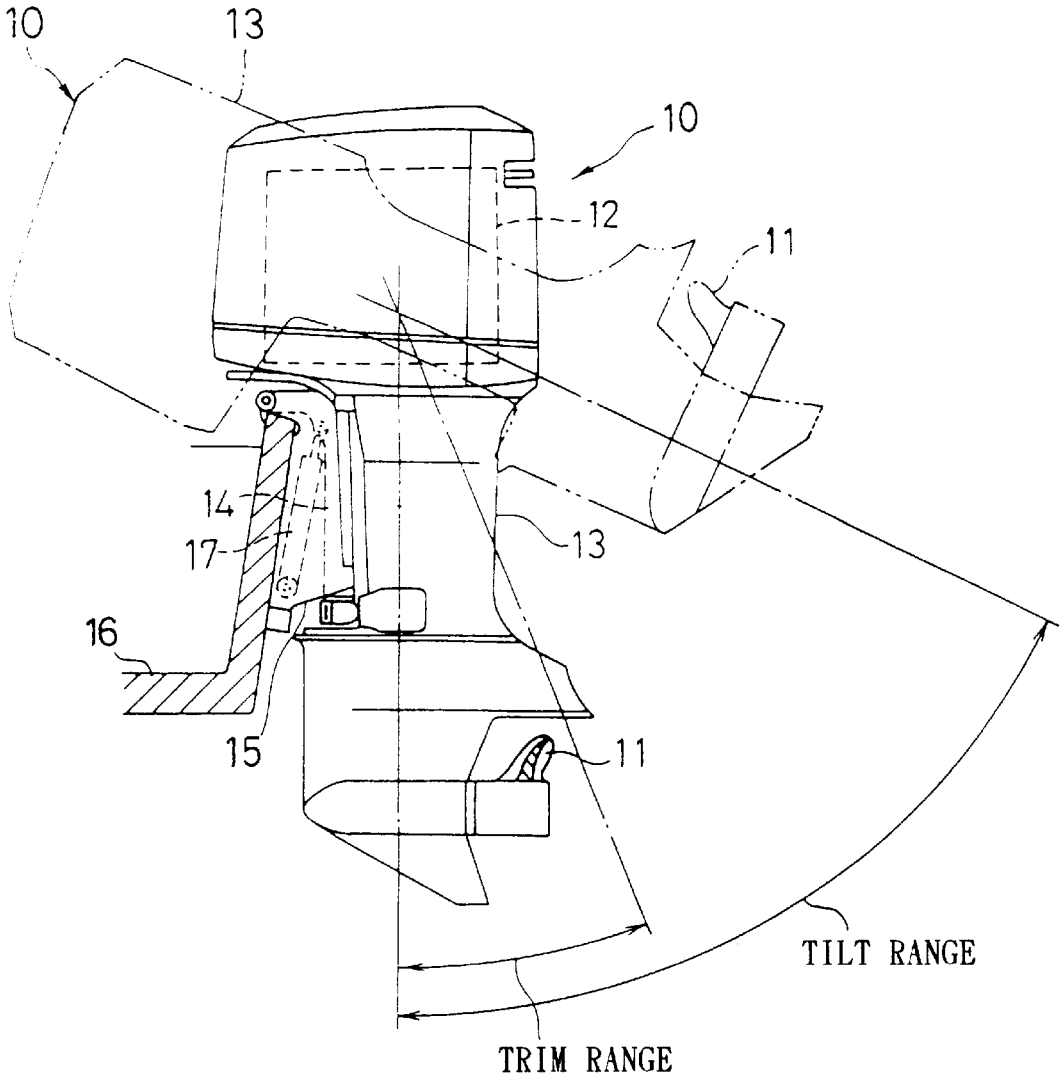
FIG. 1 is a side view of an outboard motor with a first embodiment of a tilt-trim device for a marine propulsion unit of the present invention.

As shown in FIG. 1, an outboard motor 10 as the marine propulsion unit comprises a propulsion unit 13 comprising a propeller 11 and an engine 12, supported axially by a swivel bracket 14 such that a horizontal axis swinging movement is allowed, with the swivel bracket 14 supported by a clamp bracket 15 such that a vertical axis tilting movement is allowed. Since the clamp bracket 15 grips a hull 16 so as to be fixed to the hull 16, the propulsion unit 13 can swing horizontally and tilt vertically with respect to the hull 16. By the forward or reverse rotation of the propeller 11 of the outboard motor 10, the hull 16 moves forward or backward.

A tilt-trim device 17 is provided between the swivel bracket 14 and the clamp bracket 15 of the outboard motor 10. The motive power is generated by the telescopic motion of the tilt-trim device 17 and the propulsion unit 13 of the outboard motor 10 so as to allow the tilt operation or the trim operation of the propulsion unit 13 of the outboard motor 10. The trim operation refers to the operation of adjusting the angle of the propulsion unit 13 to the thrust of the propeller 11 during the sailing of the hull 16 so as to change the sailing direction of the hull 16. The tilt operation refers to the operation of tilting the propulsion unit 13 against resistance to self-weight during a stoppage or a grounding of the hull 16 so as to raise the propulsion unit 13 above water.

As shown in FIG. 2, the tilt-trim device 17 comprises a hydraulic cylinder device 18, a pump device 19 and a tank device 20. In the tilt-trim device 17, the hydraulic cylinder device 18 comprises an inner cylinder 21 and an outer cylinder 22 formed of pipe materials, with one end portion of the inner cylinder 21 and the outer cylinder 22 assembled to a cast-molded valve block 31 of the pump device 19 as later described, with a tank case 32 of the tank device 20 connected with the valve block 31 with bolts 33 (FIG. 3) as later described.

The inner cylinder 21 and the outer cylinder 22 of the hydraulic cylinder device 18 are formed of a draw-molded pipe steel material, with a piston 23 accommodated slidably in the inner cylinder 21, which is filled with hydraulic fluid. The piston 23 is connected with a piston rod 24 at one end with a nut 25. The inside of the inner cylinder 21 is divided into a rod side space 26B for accommodating the piston rod 24 and a piston side space 26A, not for accommodating the piston rod 24 by the piston 23.

One end portion of the inner cylinder 21 is closed by a lid 28 having a through hole 27, and is sealed with an O-ring 30A. A rod guide 29 is fitted on the other end portion of the inner cylinder 21 and the outer cylinder 22, and is stopped by a bent portion 30 of the outer cylinder 22 so as to prevent slip-off. The piston rod 24 passes through the rod guide 29. Also, the other end portion of the outer cylinder 22 is sealed by O-rings 30B, 30C provided at the inner periphery and the outer periphery of the rod guide 29 respectively and a seal member 29A provided at the inner periphery of the rod guide 29.

As illustrated in FIG. 7, the bent portion 30 of the outer cylinder 22 is formed by rolling/bending of the other end portion of the outer cylinder 22. This bending is performed with the rod guide 29 being retained in the other end portion of the inner cylinder 21. The rod guide 29 is formed of aluminum alloy and has its surface treated by alumite.

A cylinder channel 34 is formed between the inner cylinder 21 and the outer cylinder 22, interconnecting the rod side space 26B via a notch portion 35 formed in the rod guide 29. The through hole 27 of the lid 28 interconnects with the piston side space 26A.

The pump device 19 comprises a gear pump 36 and a motor 37, with the valve block 31 cast-molded of an aluminum alloy or the like. A first stage portion 41, a second stage portion 42, and a third stage portion 43 are formed with diameters successively enlarged, at one end, and the gear pump 36 is fixed at the other end in the valve block 31. In the interior thereof, there are disposed various valves such as a shuttle valve device 56 later described. The gear pump 36 is interlocked with the motor 37 via a driving shaft 38 rotatable in the forward or backward direction.

Figure 3:
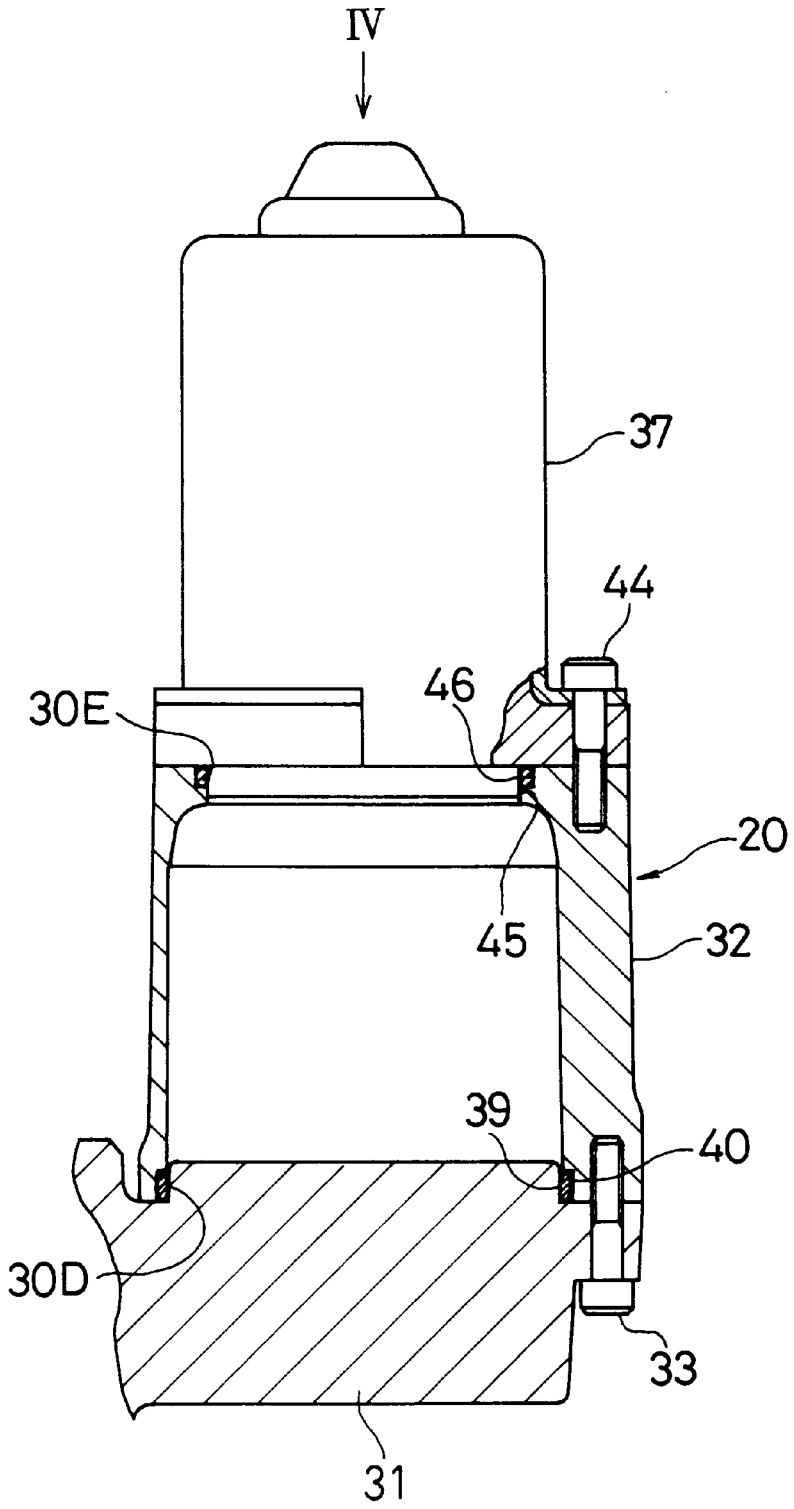
FIG. 3 is a partial cross-sectional view of the tilt-trim device taken on section line III—III of FIG. 5.
Figure 5:
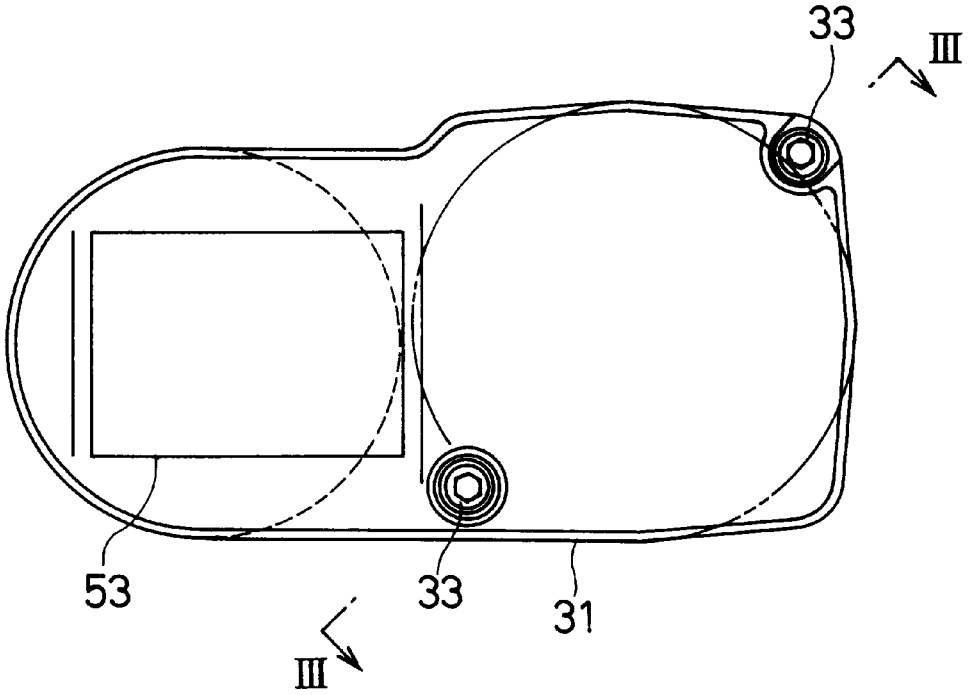
FIG. 5 is an end view viewed from the arrow V of FIG. 2.

The tank case 32, capable of storing the hydraulic fluid (fluid surface H), of the tank device 20 is provided so as to surround the gear pump 36 at the other end side of the valve block 31. The tank case 32 is supported by the valve block 31 at two points by two bolts 33 provided diagonally as shown in FIGS. 3 and 5. An O-ring 30D is arranged vertically between a fitting surface 39 of the other end of the valve block 31 and an inner periphery surface 40 of the lower end portion of the tank case 32 in FIG. 2, contacting the fitting surface 39 and the inner periphery surface 40, to seal the tank case 32 by the O-ring 30D.

Figure 4:
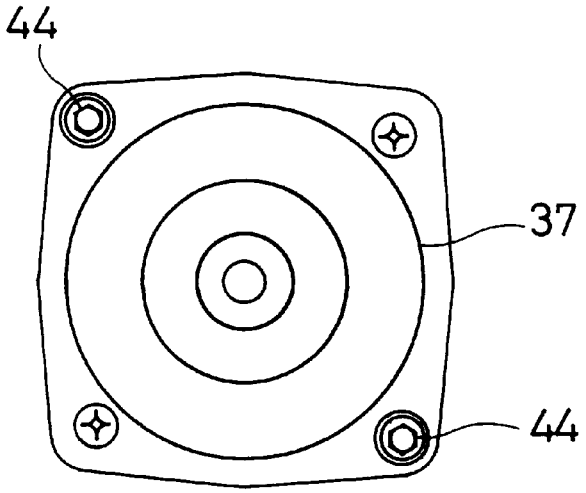
FIG. 4 is an end view viewed from the arrow IV of FIG. 3.

The motor 37 of the pump device 19 is supported by the tank case 32 at two points by two bolts 44 arranged diagonally as shown in FIGS. 3 and 4. An O-ring 30E is arranged vertically between a fitting surface 45 of the motor 37 and an inner periphery surface 46 of the upper end portion of the tank case 32 in FIG. 2, so that the tank case 32 is sealed by the O-ring 30E.

Figure 6:
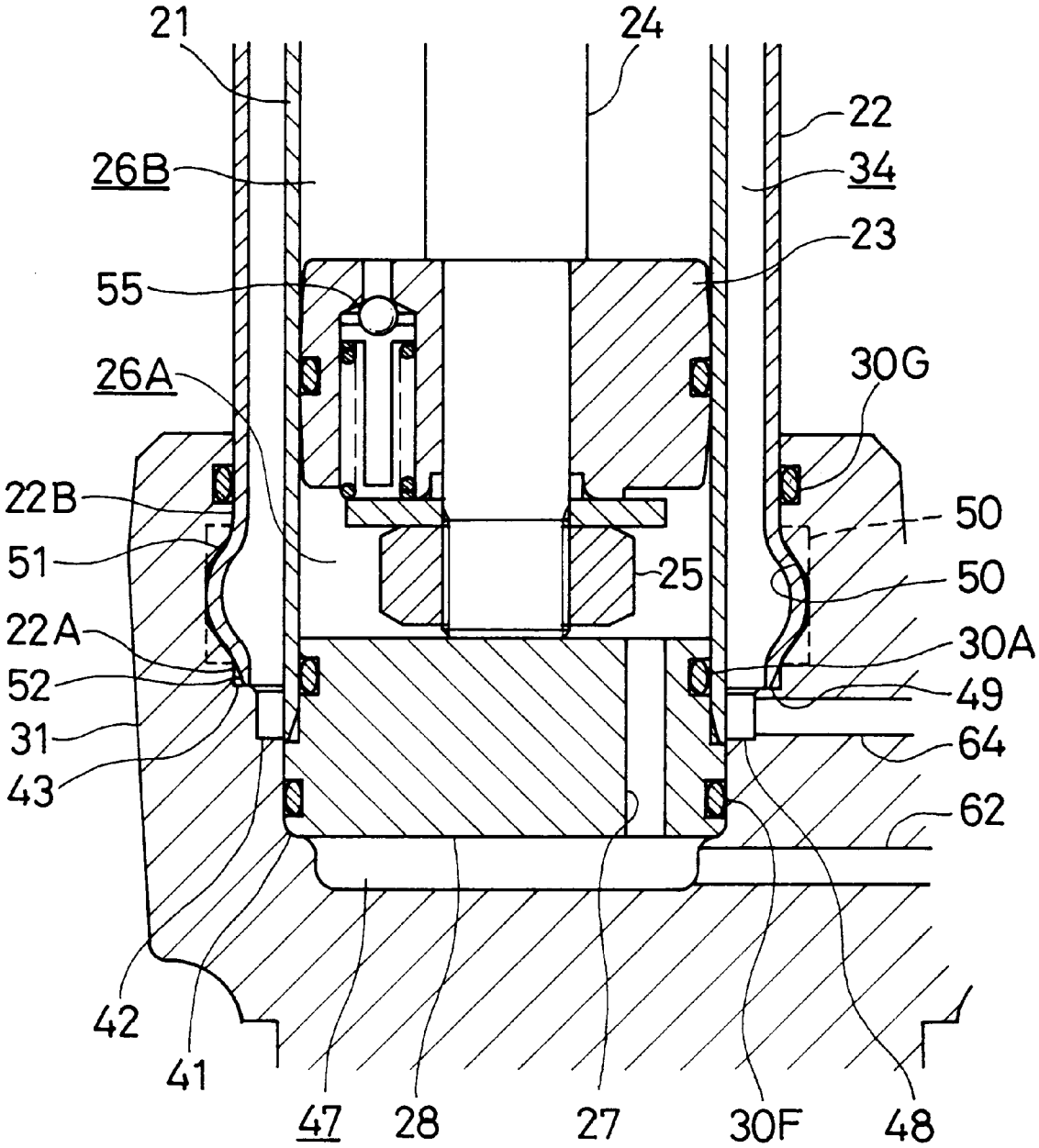
FIG. 6 is an enlarged cross-sectional view of one end portion of the cylinder.

As shown in FIG. 6, the first stage portion 41 formed at one end of the valve block 31 is formed with substantially the same diameter size as the inner cylinder 21 of the hydraulic cylinder device 18 so as to contact and fit with the closing lid 28 inserted and attached to the inner cylinder 21. In the state where the closing lid 28 is fitted, an fluid storage space 47 is formed between the closing lid 28 and the valve block 31. The fluid storage space 47 connects with the through hole 27 of the closing lid 28 with a second piston side space channel 62 formed in the valve block 31 later described.

A ring-like channel 48 is formed in the second stage portion 42 around the inner cylinder 21 fitted to the valve block 31. The ring-like channel 48 communicate with the cylinder channel 34 of the hydraulic cylinder device 18 and communicates with a second rod side space channel 64 formed in the valve block 31, later described. The ring-like channel 48 and the fluid storage space 47 are sealed by an O-ring 30F provided at the outer periphery of the closing lid 28.

The third stage portion 43 is formed with substantially the same diameter size as the outer cylinder 22 so as to contact the end surface 49 of the outer cylinder 22 and fit with one end portion of the outer cylinder 22. A ring-groove-like cylinder fixing portion 50, having a diameter larger than that of the outer cylinder 22 and a groove cross-section of a round shape, is formed in the vicinity of the third stage portion 43. In the one end portion of the outer cylinder 22, the end surface 49 contacts the third stage portion 43. A position slightly away from the end surface 49 toward the upper direction in FIG. 6 enlarged in the diameter by a bulge process so as to form a protrusion portion 51 having a round shape as the cylinder fixing portion 50. The protrusion portion 51 formed by bulge process is fitted to the cylinder fixing portion 50 so as to fix the outer cylinder 22 with the valve block 31.

At the time of forming, a linear portion 22A at the end surface 49 side and a liner portion 22B at the side opposite to the end surface 49 are supported by valve block 31 at both sides of the protrusion portion 51 with respect to the axial direction of the outer cylinder 22. Accordingly, backlash of the outer cylinder 22 with respect to the valve block 31 can be prevented so that the outer cylinder 22 can be supported securely by the valve block 31.

An O-ring 30G, in contact with the outer periphery of the linear portion 22B of the outer cylinder 22, is provided in the valve block 31 so as to seal the ring-like channel 48. Furthermore, a chamfer portion 52 is formed at the outer periphery side of the linear portion 22A of the outer cylinder 22 such that the 0 ring 30G is not damaged by the end surface 49 of the outer cylinder 22 when the outer cylinder 22 is inserted into the valve block 31.

The hydraulic cylinder device 18 is assembled to the valve block 31 of the pump device 19 according to the below-mentioned processes (1) to (3) (see FIG. 2).

(1) One end portion of the outer cylinder 22 is inserted into the third stage portion 43 and the cylinder fixing portion 50 of the valve block 31. By bulge processing of the one end portion of the outer cylinder 22, a protrusion 51 is formed. By fitting the protrusion portion 51 and the cylinder fixing portion 50 of the valve block 31, the outer cylinder 22 is fixed to the valve block 31. The bulge processing step is conducted by arranging an elastic body in one end portion of the outer cylinder 22 inserted in the valve block 31, accommodating the piston in the outer cylinder 22 and pressing the inside of the outer cylinder 22 by the piston so as to deform the one end portion of the outer cylinder 22 to the round shape of the cylinder fixing portion 50 by the elastic body.

(2) The inner cylinder assembly 21A is inserted in the outer cylinder 22 fixed on the valve block 31. The inner cylinder assembly 21A, which is assembled preliminarily before being inserted in the outer cylinder 22, comprises the inner cylinder 21 accommodating the piston 23 and the piston rod 24 therein, having the closing lid 28 and the rod guide 29 attached at the one end portion and the other end portion of the inner cylinder 21, respectively. When the inner cylinder assembly 21A is inserted in the outer cylinder 22, the closing lid 28 is fitted with the first stage portion 41 of the valve block 31.

(3) Thereafter, in a state where the rod guide 29 is fitted onto the other end portion of the inner cylinder 21 and held thereby, the other end portion of the outer cylinder 22 is rolling/bending worked. At bending portion 30, the rod guide 29 of the inner cylinder assembly 21A is fixed to the outer cylinder 22, thereby fixing the inner cylinder assembly 21A to the outer cylinder 22, thereby completing the assembling of the hydraulic cylinder 18 with respect to the valve block 31.

As shown in FIG. 2, a shaft supporting portion 53 is formed in the valve block 31 of the pump device 19 so that the tilt-trim device 17 is supported axially by the clamp bracket 15 (FIG. 1) via the shaft supporting portion 53. A shaft supporting portion 54 is provided at the tip of the piston rod 24 of the hydraulic cylinder device 18 so that the shaft supporting portion 54 is supported axially by the swivel bracket 14 (FIG. 1). As later described, by supplying or discharging of hydraulic fluid from the gear pump 36 of the pump device 19 to the piston side space 26A or the rod side space 26B of the hydraulic cylinder device 18, the hydraulic cylinder device 18 moves telescopically, that is, the piston rod 24 projects from the inner cylinder 21 and the outer cylinder 22 (extension of the hydraulic cylinder device 18) so as to tilt-up or trim-up the propulsion unit 13, or the piston rod 24 passes inside the inner cylinder 21 and the outer cylinder 22 (contraction of the hydraulic cylinder device 18) to tilt-down or trim-down the propulsion unit 13.

In FIG. 2, buffer valve 55 for discharging hydraulic fluid in the rod side space 26B into the piston side space 26A for absorbing the collision energy by the fluid resistance of the hydraulic fluid flowing in the buffer valve 55 to alleviate the impact when the propulsion unit 13 collides with an obstacle during the sailing of the hull 16 so that the pressure in the rod side space 26B increases above a predetermined value.

As shown in FIG. 8, the gear pump 36 of the pump device 19 is connected with the piston side space 26A of the hydraulic cylinder device 18 via a first piston side space channel 61, a piston side space check valve 57 of a shuttle valve device 56, the second piston side space channel 62, the fluid storage space 47 and the through hole 27 of the closing lid 28. The gear pump 36 is connected with the rod side space 26B of the hydraulic cylinder device 18 via a first rod side space channel 63, a rod side space check valve 58 of the shuttle valve device 56, a second rod side space channel 64, the ring-like channel 48, the cylinder channel 34 and the notch portion 35 of the rod guide 29.

The gear pump 36 is connected with the tank device 20 via a first tank channel 65, and a second tank channel 66. Tank space side check valves 59 for supplying the hydraulic fluid from the tank device 20 only to the gear pump 36 are provided in the first tank channel 65 and the second tank channel 66. The numeral 60 in FIG. 8 denotes a filter.

The shuttle valve 56 comprises a piston side space shuttle valve portion 67 and a rod side space shuttle valve portion 68, the piston side space shuttle valve portion 67 and the rod side space shuttle valve portion 68 are interconnected via a communication path 69. The piston side space shuttle valve portion 67 comprises a spool 72 having a piston side space operation check valve 71 slidably disposed in a shuttle cylinder 70, with the inside of the shuttle valve cylinder 70 being divided into a main fluid space 73 and a sub fluid space 74. A piston side space check valve 57 is provided in the main fluid space 73.

The rod side space shuttle valve 68 has a spool 72 having a rod side space operation check valve 75 slidably disposed in a shuttle cylinder 70, with the inside of the shuttle valve cylinder 70 divided into a main fluid space 73 and a sub fluid space 74. A rod side space check valve 58 is provided in the main fluid space 73. The sub fluid spaces 74 of the piston side space shuttle valve portion 67 and the rod side space shuttle valve portion 68 interconnect through the communication path 69.

The spool 72 of the piston side space shuttle valve portion 67 and the spool 72 of the rod side space shuttle valve portion 68 move toward the piston side space check valve 57 and the rod side space check valve 58, respectively by the pressure rise in the sub fluid space 74 so that the piston side space check valve 57 and the rod side space check valve 58 can be opened by the fluid pressure.

When the gear pump 36 rotates in the forward direction, the gear pump 36 guides the hydraulic fluid in the tank space 20 into the main fluid space 73 of the piston side space shuttle valve portion 67 in the shuttle valve device 56 via the first tank channel 65 and the first piston side space channel 61 as shown by the solid arrow in FIG. 8. The hydraulic fluid guided into the main fluid space 73 of the piston side space shuttle valve portion 67 opens the piston side space check valve 57 and also opens the piston side space operation check valve 71, and flows into the sub fluid space 74 of the rod side space shuttle valve portion 68 via the sub fluid space 74 and the communication path 69. Since the rod side space operation check valve 75 is open, the spool 72 of the rod side space shuttle valve portion 68 moves toward the rod side space check valve 58 so as to open the rod side space check valve 58.

Upon opening of the piston side space check valve 57, the hydraulic fluid in the main fluid space 73 of the piston side space shuttle valve portion 67 passes into the piston side space 26A of the hydraulic cylinder device 18 via the second piston side space channel 62, the fluid storage space 47 and the through hole 27, and the hydraulic fluid in the rod side space 26B is guided to the gear pump 36 via the notch portion 35, the cylinder channel 34, the ring-like channel 48, the second rod side space channel 64, the rod side space check valve 58 (opened state) and the first rod side space channel 63 as shown by the solid arrow in FIG. 8. As a result, the piston 23 moves in the direction such that the piston rod 24 of the hydraulic cylinder device 18 projects from the inner cylinder 21 and the outer cylinder 22 to extend the hydraulic cylinder device 18. The tilt-up and trim-up operation of the propulsion unit 13 of the outboard motor 10 is thereby carried out.

When the gear pump 36 rotates in the reverse direction, the gear pump 36 guides hydraulic fluid in the tank device 20 into the main fluid space 73 in the rod side space shuttle valve portion 68 of the shuttle valve device 56 via the second tank channel 66 and the first rod side space channel 63 as shown by the broken arrow in FIG. 8. The hydraulic fluid introduced into the main fluid space 73 of the rod side space shuttle valve portion 68 opens the rod side space check valve 58 as well as opens the rod side space operation check valve 75, and flows into the sub fluid space 74 of the rod side space shuttle valve portion 67 via the sub fluid space 74 and the communication path 69. Since the piston side space operation check valve 71 is closed, the spool 72 of the piston side space shuttle valve portion 67 moves toward the piston side space check valve 57 so as to open the piston side space check valve 57.

On the opening of the rod side space check valve 58, the hydraulic fluid in the main fluid space 73 of the rod side space shuttle valve portion 68 reaches into the rod side space 26B of the hydraulic cylinder device 18 via the second rod side space channel 64, the ring-like channel 48, cylinder channel 34 and the notch portion 35, and the hydraulic fluid in the piston side space 26A is returned to the gear pump 36 via the hole 27, the fluid storage space 47, the second piston side space channel 62, the piston side space check valve 57 (opened state) and the first piston side space channel 61 as shown by the broken arrow in FIG. 8. As a result, the piston 23 moves in the direction such that the piston rod 24 enters into the inner cylinder 21 and the outer cylinder 22 to contract the hydraulic cylinder device 18. The tilt-down and trim-down operation of the propulsion unit 13 of the outboard motor 10 is thereby carried out.

In the hydraulic circuit of the tilt-trim device 17, a down blow orifice 76 is connected to the first rod side space channel 63, a manual valve 77 is connected to the second piston side space channel 62, and a suction check valve 78 is connected to the second rod side space channel 64. The manual valve 77 enables the second piston side space channel 62 to connect to an up blow thermal blow valve 79 in the ordinary non-operation time.

The down blow orifice 76 guides the hydraulic fluid corresponding to the volume of the piston rod 24 entering the inner cylinder 21 into the tank device 20 at the time the hydraulic cylinder device 18 contracts.

The manual valve 77 is for returning the hydraulic fluid in the piston side space 26A of the hydraulic cylinder device 18 to the tank device 20 manually by the operator so as to contract the hydraulic cylinder device 18 manually in combination with the function of the suction check valve 78 later described for allowing the tilt-down of the propulsion unit 13 manually when the tilt-trim device 17 is out of order.

The suction check valve 78 introduces hydraulic fluid in the tank device 20 into the rod side space 26B of the hydraulic cylinder device 18 when the manual valve 77 is in operation, contributing to the manual contraction of the hydraulic cylinder device 18.

The up blow thermal blow valve 79 has the up blow function for introducing excessive hydraulic fluid into the tank device 20 when the gear pump 36 still rotates in the forward direction with the hydraulic cylinder device 18 extended even though the piston 23 contacts with the rod guide 29, and a thermal blow function for exhausting the increased hydraulic fluid in to the tank device 20 when the volume of the hydraulic fluid in the piston side space 26A of the hydraulic cylinder device 18 and the second piston side space channel 62 is increased by the temperature change.

According to the tilt-trim device 17 with the above-described construction, the following advantages (1) to (3) are obtained.

(1) Since the other end portion of the outer cylinder 22 made of pipe material is worked by bending and the rod guide 29 is fixed to the other end portion of the outer cylinder 22 by such bending portion 30, the fixing of the rod guide 29 can be facilitated compared to the fixing of the rod guide 29 to the other end portion of the outer cylinder 22 that is performed by forming an internal thread in the inner periphery of the other end portion of the outer cylinder 22 and forming an external thread in the outer periphery of the rod guide 29 and thereby bringing these internal and external threads into screw engagement with each other.

(2) Since it is not necessary to form an internal thread in the inner periphery of the other end portion of the outer cylinder 22, it is possible to reduce the thickness of the outer cylinder 22.

(3) Since the rod guide 29 is fixed to the other end portion of the outer cylinder 29 in a state where the rod guide 29 has been retained by the other end surface of the inner cylinder 21, it is not necessary to provide separately a member or portion for positioning and retaining this rod guide 29 with respect to the outer cylinder 22 before fixing the rod guide 29, with the result that the increase in cost can be avoided.

FIG. 9 is a sectional view, corresponding to FIG. 7, of a tilt-trim device of the outboard motor, which is a second embodiment of the tilt-trim device of the marine propulsion unit according to the present invention. In this second embodiment, similar portions to those in the first embodiment are denoted by like reference symbols, thereby omitting an explanation thereof.

In a hydraulic cylinder device 81 of a tilt-trim device 80 according to this second embodiment, an annular concave portion 83 is formed in a peripheral edge of a rod guide 82 and a convex portion 84 is formed inside this concave portion 83 adjacently thereto. The concave portion 83 accommodates therein an annular bending portion 30 formed by rolling/bending steps on the other end portion of the outer cylinder 22. Also, the convex portion 84 is formed on an outer surface of the concave portion 83 in such a way that the portion 84 has a height which is equal to or larger than that corresponding to the thickness of the outer cylinder 22.

According to this second embodiment, the following advantage (4) is obtained in addition to the advantages (1) to (3) attainable with the tilt-trim device 17 according to the first embodiment.

(4) Since on the end surface on the outer side of the rod guide 82 there is formed the convex portion 84 adjacently to the concave portion 83 accommodating therein the bending portion 30 of the outer cylinder 22 and this convex portion 84 is provided on the outer surface of the concave portion 83 to a height which is equal to or larger than that corresponding to the thickness of the outer cylinder 22, after having fixed the rod guide 82 to the outer cylinder 22 by bending, no recess is formed in the end surface on the rod guide 82 side of the hydraulic cylinder device 81 and therefore it is possible to prevent water from being pooled in the rod guide 82 side end surface of the hydraulic cylinder 81, thereby making this end surface unlikely to rust.

FIG. 10 is a sectional view, corresponding to FIG. 7, of a tilt-trim device of the outboard motor which is a third embodiment of the tilt-trim device of the marine propulsion unit according to the present invention. In this third embodiment, similar portions to those in each of the first and second embodiment are denoted by like reference symbols, thereby omitting an explanation thereof.

In a hydraulic cylinder device 91 of the tilt-trim device 90 according to this third embodiment, the piston 23 fixed to one end portion of the piston rod 24 is freely slidably disposed within a single cylinder 92 and the piston rod 24 passes through the rod guide 82. Also, this rod guide 82 is fixed to the cylinder 92 by bent portion 93 formed by performing rolling/bending worked of the other end portion of the cylinder 92. The bending is performed with the rod guide 82 being retained by a retaining portion 94 of the cylinder 92. This retaining portion 94 is formed by inward bending of a portion in the vicinity of the other end portion of the cylinder 92 and from the outside thereof.

Accordingly, in this third embodiment as well, there are brought about the advantages (1), (2) and (4) that are attainable with the first and second embodiments.

As has been described above, according to the present invention, it is possible to easily fix the rod guide to the cylinder. Furthermore, the present invention brings about the greater advantage of preventing water from being pooled in the rod guide side end surface of the cylinder device and thereby rendering this end surface unlikely to rust.

While the preferred embodiments of the invention have been described in detail with reference to the drawings, they are by no means limitative, and various changes and modifications are possible without departing from the scope and spirit of the invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A tilt-trim device for a marine propulsion unit comprising a cylinder means that has an inner cylinder and an outer cylinder, said cylinder means for tilt-trim operation of said propulsion unit; a rod guide fixed to the end portions of said inner cylinder and said outer cylinder; a piston fixed to one end portion of a piston rod and freely slideably housed in a oil chamber of said inner cylinder with a hydraulic fluid filled within the cylinder means; the piston rod being disposed to pass through the rod guide;

a tank device in which the hydraulic fluid can be stored;

a pump device intended to supply to and discharge from the cylinder means with hydraulic fluid inside of the tank, to cause the expansion and contraction operation of the cylinder means, whereby the inner cylinder and the outer cylinder are formed of pipe material, wherein an inner-end-face of the rod guide facing the oil chamber of the rod guide held on the end portion of the inner cylinder, the rod guide sandwiched and fixed between the inner cylinder and the outer cylinder by bending the end portion of the outer cylinder inwardly at an outer-end-face of the rod guide.

2. A tilt-trim device for a marine propulsion unit according to claim 1, wherein the end surface on the other side of the rod guide is formed with a concave portion accommodating therein a bent portion of the outer cylinder and a convex portion on the concave portion to a height which is equal to or larger that the thickness of the outer cylinder.

* * * * *